US005634538A

United States Patent [19]

Tsai

[11] Patent Number: 5,634,538

[45] Date of Patent: Jun. 3, 1997

[54] WHEEL ASSEMBLY MOUNTING STRUCTURE FOR TRUNKS

[76] Inventor: Cheng-Hsien Tsai, No. 103, Da-Ming 1st Rd., Tien-Tzu Hsiang, Taichung Hsien, Taiwan

[21] Appl. No.: 501,621

[22] Filed: Jul. 12, 1995

[51] Int. Cl.[6] ..... A45C 5/14; A45C 13/36

[52] U.S. Cl. ..... 190/18 A; 190/126

[58] Field of Search ..... 190/18 A, 126

[56] References Cited

U.S. PATENT DOCUMENTS

| | | | |
|---|---|---|---|
| 5,083,645 | 1/1992 | Lee | 190/126 X |
| 5,115,895 | 5/1992 | Myers | 190/18 A |
| 5,163,539 | 11/1992 | Yang | 190/18 A |
| 5,295,565 | 3/1994 | Latshaw | 190/18 A |
| 5,393,079 | 2/1995 | Wang | 190/18 A |
| 5,431,262 | 7/1995 | Rekuc et al. | 280/37 X |
| 5,431,428 | 7/1995 | Marchwiak et al. | 280/37 X |
| 5,482,147 | 1/1996 | Wang | 190/18 A X |

*Primary Examiner*—Sue A. Weaver
*Attorney, Agent, or Firm*—Bacon & Thomas

[57] ABSTRACT

A wheel assembly mounting structure includes a trunk body having a back frame covered with a back cover, which back frame having an arched bottom end defining with the bottom side of the trunk body two wheel assembly mounting chambers, two wheel assembly mounting frames respectively mounted in the wheel assembly mounting chambers inside the trunk body and bilaterally attached to the arched bottom end of the back frame at an inner side and having a respective mounting groove fitting the periphery of the arched bottom end of the back frame, and two wheel assemblies respectively mounted in wheel assembly mounting chambers outside the trunk body and bilaterally attached to the arched bottom end of the back frame at an outer side and respectively fixed to the wheel assembly mounting frames by fastening elements.

3 Claims, 3 Drawing Sheets

WHEEL ASSEMBLY MOUNTING STRUCTURE FOR TRUNKS

BACKGROUND OF THE INVENTION

The present invention relates to trunks for travelers for holding clothes, and relates more particularly to a wheel assembly mounting structure for trunks which comprises a trunk body having a back frame, which back frame has an arched bottom end defining with the bottom side of the trunk body two wheel assembly mounting chambers, two wheel assembly mounting frames respectively mounted in the wheel assembly mounting chamber and bilaterally attached to the arched bottom end of the back frame at an inner side, and two wheel assemblies respectively mounted in the wheel assembly mounting frame and bilaterally attached to the arched bottom end of the back frame at an outer side and fixed to the wheel assembly mounting frames by fastening elements.

A variety of trunks have been disclosed for travelers for holding clothes, and have appeared on the market. These trunks commonly comprise a trunk body having a fixed back cover and a re-openable front cover, a carrying handle at the top side, and two wheel assemblies at the bottom side. As the wheel assemblies are fixed to the bottom side of the trunk body on the outside, they take much storage space and tend to be damaged when hit by an object.

SUMMARY OF THE INVENTION

The present invention has been accomplished to provide a wheel assembly mounting structure which eliminates the aforesaid drawbacks.

According to one aspect of the present invention, the wheel assembly mounting structure comprises a trunk body having a back frame covered with a back cover, which back frame having an arched bottom end defining with the bottom side of the trunk body two wheel assembly mounting chambers, two wheel assembly mounting frames respectively mounted in the wheel assembly mounting chambers inside the trunk body and bilaterally attached to the arched bottom end of the back frame at an inner side, and two wheel assemblies respectively mounted in wheel assembly mounting chambers outside the trunk body and bilaterally attached to the arched bottom end of the back frame at an outer side and respectively fixed to the wheel assembly mounting frames by fastening elements.

According to another aspect of the present invention, each wheel assembly has an outward flange fitting the periphery of the arched bottom end of the back frame of the trunk body, and a plurality of through holes on the outward flange for connection to respective through holes on the respective wheel assembly mounting frame by respective fastening elements.

According to still another aspect of the present invention, each wheel assembly mounting frame has a mounting groove fitting the periphery of the arched bottom end of the back frame of the trunk body, and a plurality of through holes respectively connected to the respective through holes on the respective wheel assembly by respective fastening elements.

DETAILED DESCRIPTION OF THE PREFERRED EMBODIMENT

Figure 1:
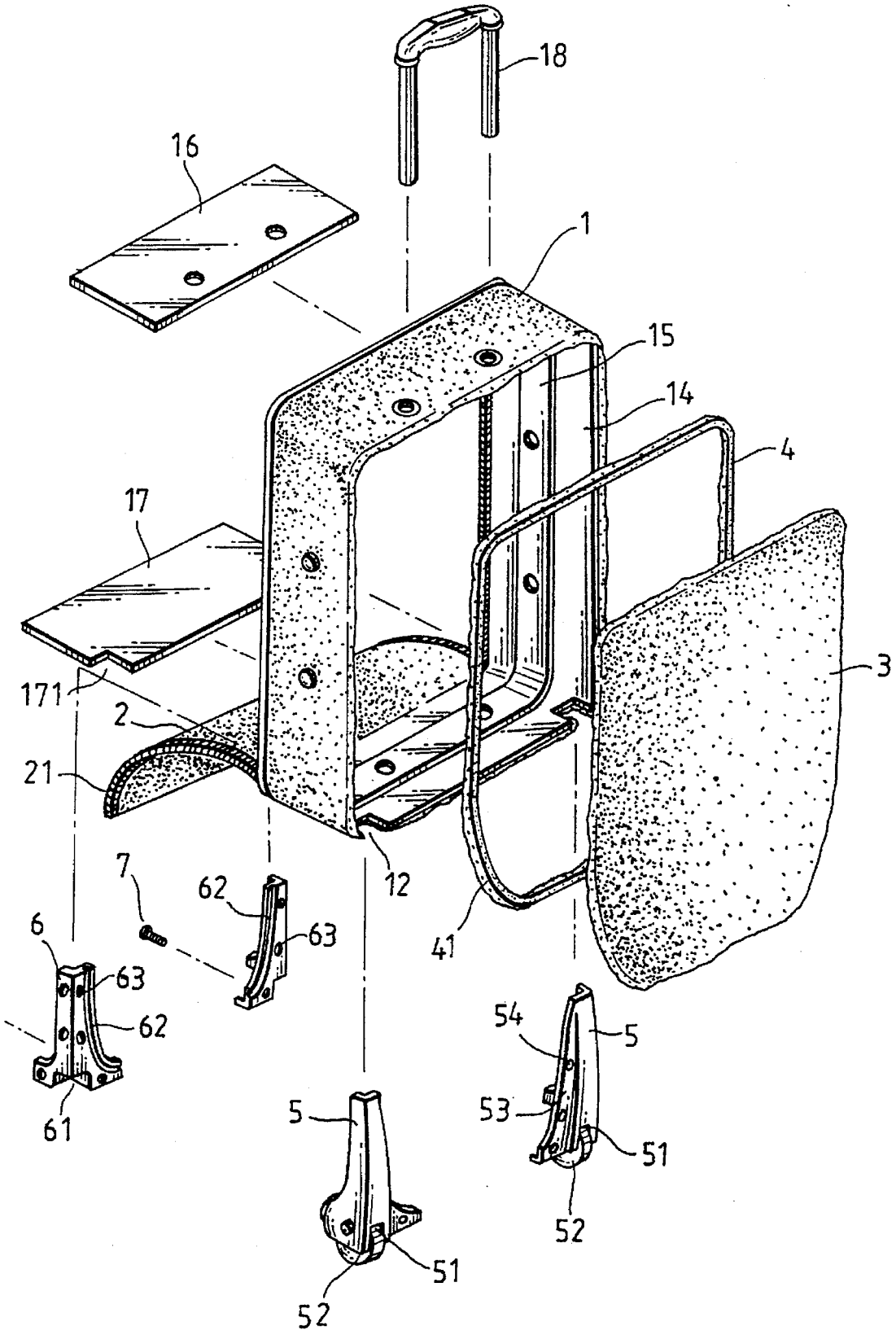
FIG. 1 is an exploded view of a trunk according to the present invention.

Referring to FIG. 1, a wheel assembly mounting structure for trunks in accordance with the present invention is generally comprised of a trunk body 1, a front cover 2, a back cover 3, a back frame 4, two wheel assembly mounting frames 6, two wheel assemblies 5, and a plurality of fastening elements 7.

Figure 2:
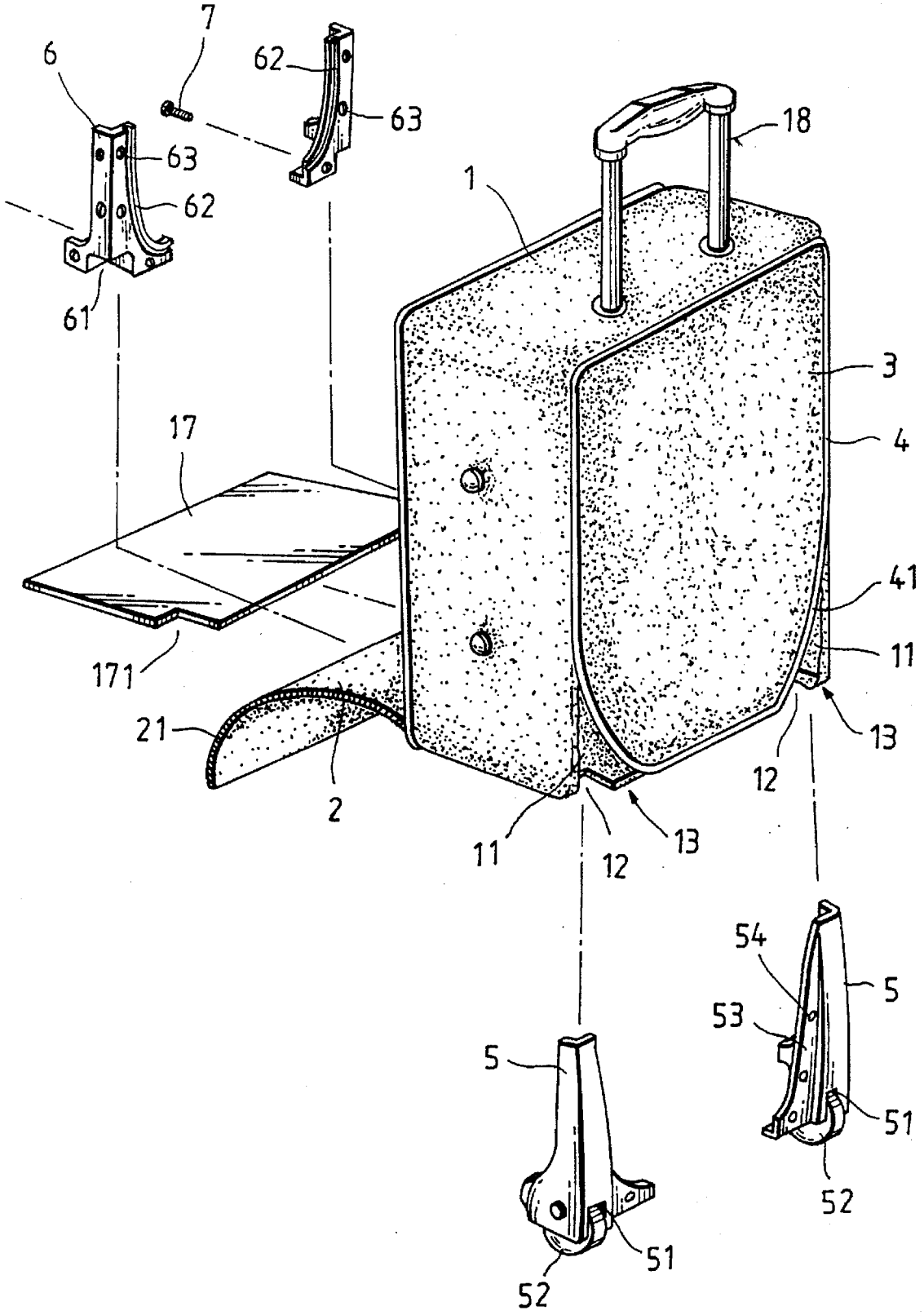
FIG. 2 is another exploded view of the trunk according to the present invention.

Referring to FIG. 2 and FIG. 1 again, a handle 18 is coupled to the trunk body 1 at the top side. The front cover 2 has one side fixedly secured to the trunk body i by stitches and the other peripheral sides reopenably fastened to the trunk body i by a ziF fastener 21. The back cover 3 is stretched on the back frame 4 and then fixedly secured to the back side of the trunk body 1 opposite to the front cower 2. The back frame 4 has an arched bottom end 41, which defines with the back side of the trunk body 1 two openings 11. The trunk body 1 has two opposite bottom notches 12. The bottom notches 12 and the openings 11 are incorporated into two wheel assembly mounting chambers 13 for mounting the wheel assembly mounting frames 6 and the wheel assemblies 5. The wheel assembly mounting frames 6 are fixedly secured inside the wheel assembly mounting chambers 13. The wheel assemblies 5 are respectively fastened to the wheel assembly mounting frames 6 by the fastening elements 7.

The trunk body 1 comprises a lining board 14 on the inside around the periphery reinforced by a supporting frame 15 to support the soft covering of the trunk body 1. The top reinforcing plate 16 is fixed between the lining board 14 and the supporting frame 15 at the top side. A bottom reinforcing plate 17 is fixed between the lining board 14 and the supporting frame 15 at the bottom side, having two notches 171 respectively fit the notches 12 on the trunk body i for mounting the wheel assembly mounting frames 6 and the wheel assemblies 5. Each wheel assembly 5 comprises a bottom wheel chamber 51, a wheel 52 mounted in the wheel chamber 51, an outward flange 53, and a plurality of through holes 54 on the outward flange 53. Each wheel assembly mounting frame 6 comprises a bottom receptacle portion 61, which receives the bottom wheel chamber 51 of one wheel assembly 5, a mounting groove 62, which receives the arched bottom end 41 of the back frame 4 at one side, and a plurality of through holes 63 for connection to the through holes 54 on one wheel assembly 5 by the fastening elements 7. The fastening elements 7 can be screw bolts, screw rods, etc.

Figure 3:
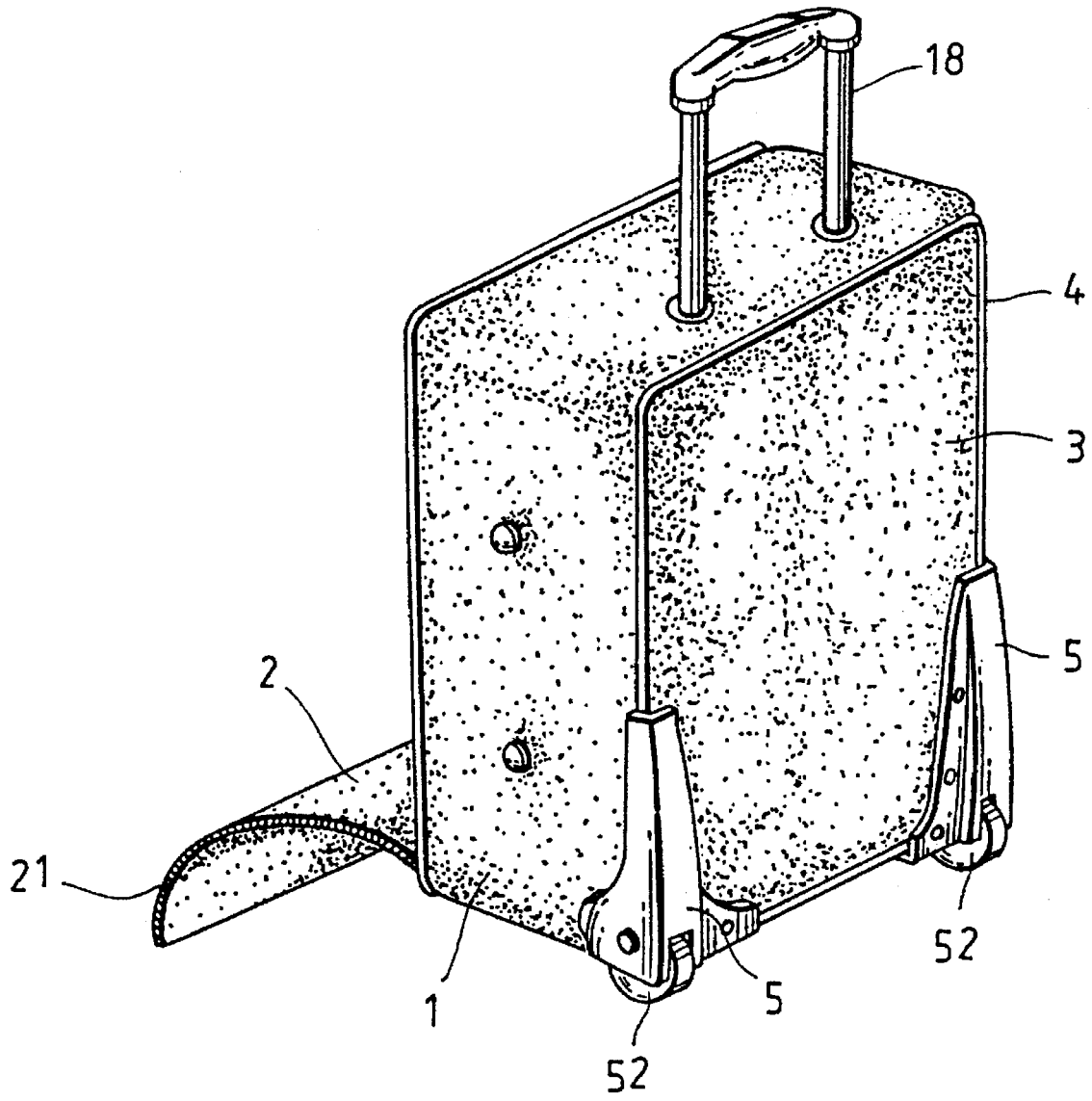
FIG. 3 shows the wheel assemblies of the trunk installed.

Referring to FIG. 3 and FIG. 2 again, when the wheel assemblies 5 are respectively inserted into the notches 12 on the trunk body 1, the wheel chambers 51 of the wheel assemblies 5 are respectively set in the wheel assembly mounting chambers 13, permitting the outward flanges 53 of the wheel assemblies 5 to be respectively and bilaterally attached to the arched bottom end 41 of the back frame 4 at an outer side, then the wheel assembly mounting frames 6 are respectively set into the inside of the trunk body 1 and attached to the arched bottom end 41 of the back frame 4 and the outward flanges 53 of the wheel assemblies 5, permitting the wheel chambers 51 of the wheel assemblies 5 to be respectively fitted into the bottom receptacle portions 61 and the arched bottom end 41 of the back frame 4 fitted into the mounting grooves 62, and then the through holes 63 on the wheel assembly mounting frames 6 are respectively fastened to the through holes 54 on the wheel assemblies 5 by the fastening elements 7. When assembled, the wheel assembly mounting frames 6 and the wheel assemblies 5 are covered on the arched bottom end 41 of the back frame 4, the wheel assembly mounting frames 6 are disposed inside the trunk body 1 and concealed from sight.

It is to be understood that the drawings are designed for purposes of illustration only, and are not intended as a definition of the limits and scope of the invention disclosed.

What is claimed is:

1. A trunk having a wheel assembly mounting structure comprising:

a trunk body having opposite sides, a back side with a back frame, and a soft back cover stretched on the back frame and fixed to the back side and a bottom side, said back frame having an arched bottom end portion which, with said opposite sides and said bottom side form two wheel assembly mounting chambers, said bottom side having a notch at each of the mounting chambers;

a wheel assembly mounting frame respectively mounted in each of said wheel assembly mounting chambers inside said trunk body and bilaterally attached to the arched bottom end portion of said back frame wherein each wheel assembly mounting frame comprises a mounting groove fitting over the arched bottom end portion of said back frame; and a wheel assembly respectively located outside said trunk body and bilaterally attached to the arched bottom end portion of said back frame at an outer side and fixed to each of said wheel assembly mounting frames by fastening elements.

2. The wheel assembly mounting structure of claim 1 wherein each wheel assembly further comprises a bottom wheel chamber, a wheel mounted in the wheel chamber, an outward flange fitting over the arched bottom end of said back frame, and a plurality of through holes on said outward flange for mounting said fastening elements.

3. The wheel assembly mounting structure of claim 2 wherein each wheel assembly mounting frame comprises a plurality of through holes respectively connected to the through holes on the outward flange of a respective one of said wheel assemblies by said fastening elements.

* * * * *